US007271768B2

(12) United States Patent
Chang et al.

(10) Patent No.: US 7,271,768 B2
(45) Date of Patent: Sep. 18, 2007

(54) CIRCULARLY POLARIZED ARRAY ANTENNA

(75) Inventors: The-Nan Chang, Taipei (TW); Ko-Han Lu, Taipei (TW)

(73) Assignee: Tatung Co., Ltd., Taipei (TW)

( * ) Notice: Subject to any disclaimer, the term of this patent is extended or adjusted under 35 U.S.C. 154(b) by 66 days.

(21) Appl. No.: 11/229,544

(22) Filed: Sep. 20, 2005

(65) Prior Publication Data

US 2006/0132359 A1 Jun. 22, 2006

(30) Foreign Application Priority Data

Dec. 22, 2004 (TW) ..... 93140083 A

(51) Int. Cl.
*H01Q 1/38* (2006.01)
*H01Q 13/10* (2006.01)

(52) U.S. Cl. ..... 343/700 MS; 343/770

(58) Field of Classification Search ..... 343/700 MS, 343/853, 770

See application file for complete search history.

(56) References Cited

U.S. PATENT DOCUMENTS 6,642,908 B2 * 11/2003 Pleva et al. ..... 343/876
7,075,485 B2 * 7/2006 Song et al. ..... 343/700 MS

* cited by examiner

*Primary Examiner*—Shih-Chao Chen
(74) *Attorney, Agent, or Firm*—Lowe, Hauptman, Ham & Berner

(57) ABSTRACT

The invention relates to a circularly polarized array antenna for receiving and transmitting a circularly polarized signal. The circularly polarized array antenna comprises: a plurality of circularly polarized antennas with phase shift mechanism for receiving circularly polarized signals and transmitting the circularly polarized signals; a plurality of power lines which differ from each other in length and are coupled to the circularly polarized antennas respectively; and a power divider coupled to the power lines for receiving the circularly polarized signals. Wherein each of the circularly polarized antennas comprises a plurality of antenna elements and each comprises a microstrip antenna and a slot coupling apparatus.

13 Claims, 6 Drawing Sheets

CIRCULARLY POLARIZED ARRAY ANTENNA

BACKGROUND OF THE INVENTION

1. Field of the Invention

The present invention relates to a circularly polarized array antenna and, more particularly, to the circularly polarized array antenna that comprises a plurality of circularly polarized antennas.

2. Description of Related Art

In the field of high-frequency communication (e.g., artificial satellite communication), due to the effect of signals passing through the ionosphere, the circularly polarized array antenna is generally used as a medium to receive circularly polarized signals. Moreover, due to the possibility for existence of two orthogonal polarization signals, every single polarized signal can be used to carry data so that orthogonal polarized signals (such as right hand or left hand signals) can be used in a neighboring area.

As shown in FIG. 1, U.S. Pat. No. 4,543,579 entitled "Circular Polarization Antenna" discloses a traditional circular polarization antenna array antenna, comprising an input/output terminal 5 and traditional antenna elements 1-1 to 1-7. The traditional antenna elements 1-1 to 1-7 further couple to input/output terminal 5 via feeding lines 3-1 to 3-7 respectively. The traditional antenna elements 1-1 to 1-7 can form a set with two antenna elements respectively to receive circular polarization signals, further output the circular polarization signals to input/output terminal 5, and then via input/output terminal 5, output the polarization signals to an amplifier and demodulator (not shown in figure). Therefore, traditional circular polarization array antenna can function as the medium for transmitting/receiving circular polarization signals. However, there is still room for improvement to the traditional circular polarized array antenna. Moreover, the production process for traditional circular polarization antenna elements 1-1 to 1-7 is rather complex. With the spirit for researching and innovating, the inventors of the present invention aimed to improve the traditional circular polarization array antenna and finally invented the circular polarization array antenna according to the invention.

SUMMARY OF THE INVENTION

To avoid the disadvantage of traditional circularly polarized array antenna, the present invention discloses a circularly polarized array antenna for receiving and transmitting a circularly polarized signal.

The circularly polarized array antenna comprises: a plurality of circularly polarized antennas with phase shift mechanism for receiving the circularly polarized signal; a plurality of power lines which differ from each other in length and couple to the circularly polarized antennas respectively; and a power divider coupled to the power lines for receiving the circularly polarized signal from the circularly polarized antennas and transmitting the circularly polarized signal.

Each of the circularly polarized antennas comprises a plurality of antenna elements each of which comprising a microstrip antenna and a slot coupling apparatus. The slot coupling apparatus further comprises a substrate, a cross-slot, and metal wire/line. There is an opening in the center of the substrate and it is formed as a rectangular slot In addition, the cross-slot and power distribution circuit formed by the metal wire are posited on the facade and reverse side of the substrate.

The circularly polarized array antenna of the present invention is formed by arranging and adjusting the circularly polarized antenna. The circularly polarized array antenna has a phase shift mechanism and operates in cooperation with a plurality of power lines and a power divider.

The circularly polarized array antenna according to the invention not only can receive the circularly polarized signals, but also has the outstanding ability to transmit the circularly polarized signals.

It also has the characteristics of low-cost and easy production to avoid the disadvantage of traditional circularly polarized array antenna to satisfy users' need in receiving and transmitting circularly polarized signals.

Additional features and advantages of the present invention will be set forth in part in the description which follows, and in part will be obvious from the description, or may be learned by practice of the present invention.

The features and advantages of the present invention will be realized and attained by means of the elements and combinations particularly pointed out in the henceforth-appended claims.

It is to be understood that both the foregoing general description and the following detailed description are exemplary and explanatory only and are not restrictive of the present invention, as claimed.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
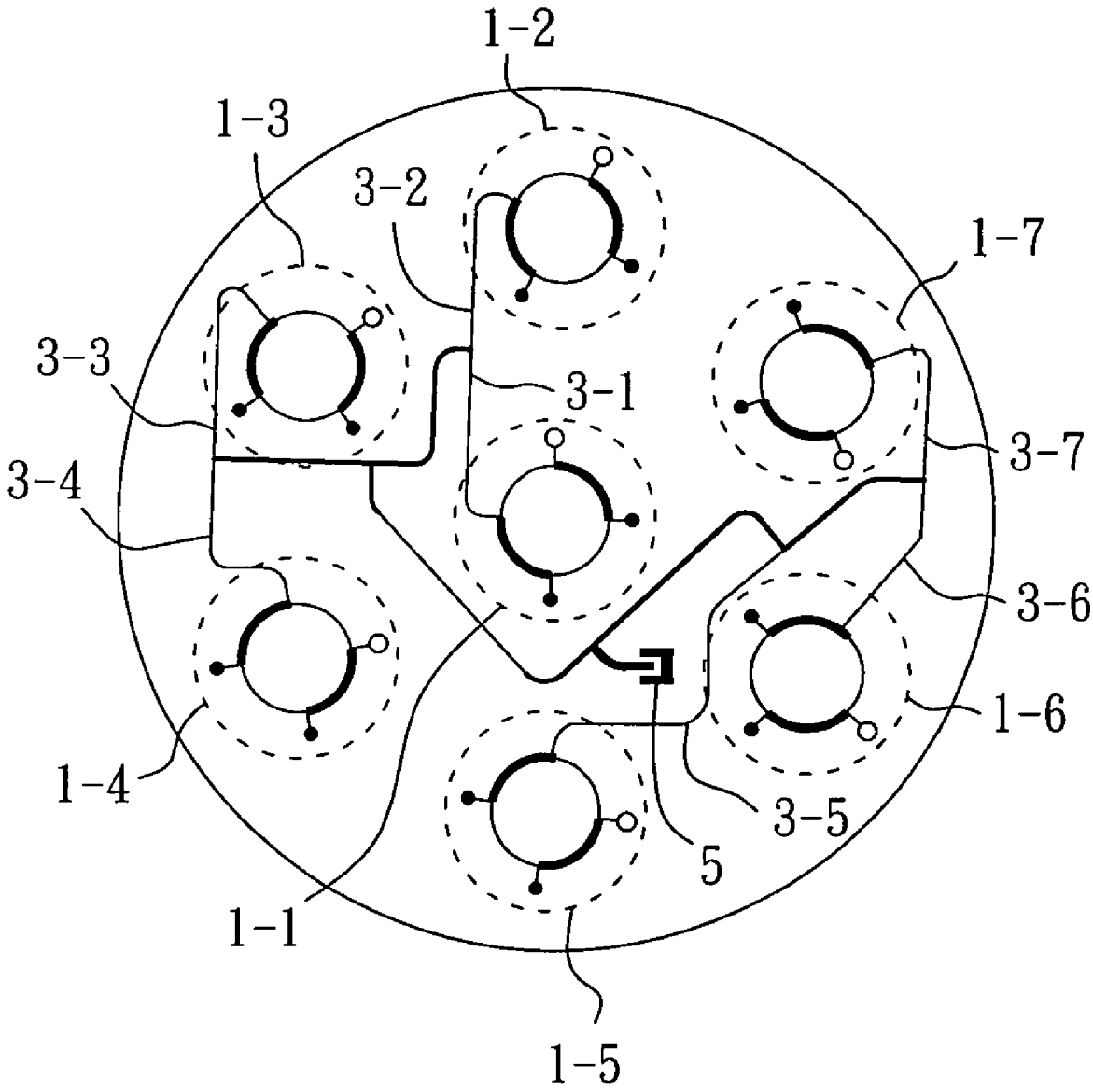
FIG. 1 (PRIOR ART)
FIG. 1 is a diagram of traditional circularly polarized array antenna.
Figure 2:
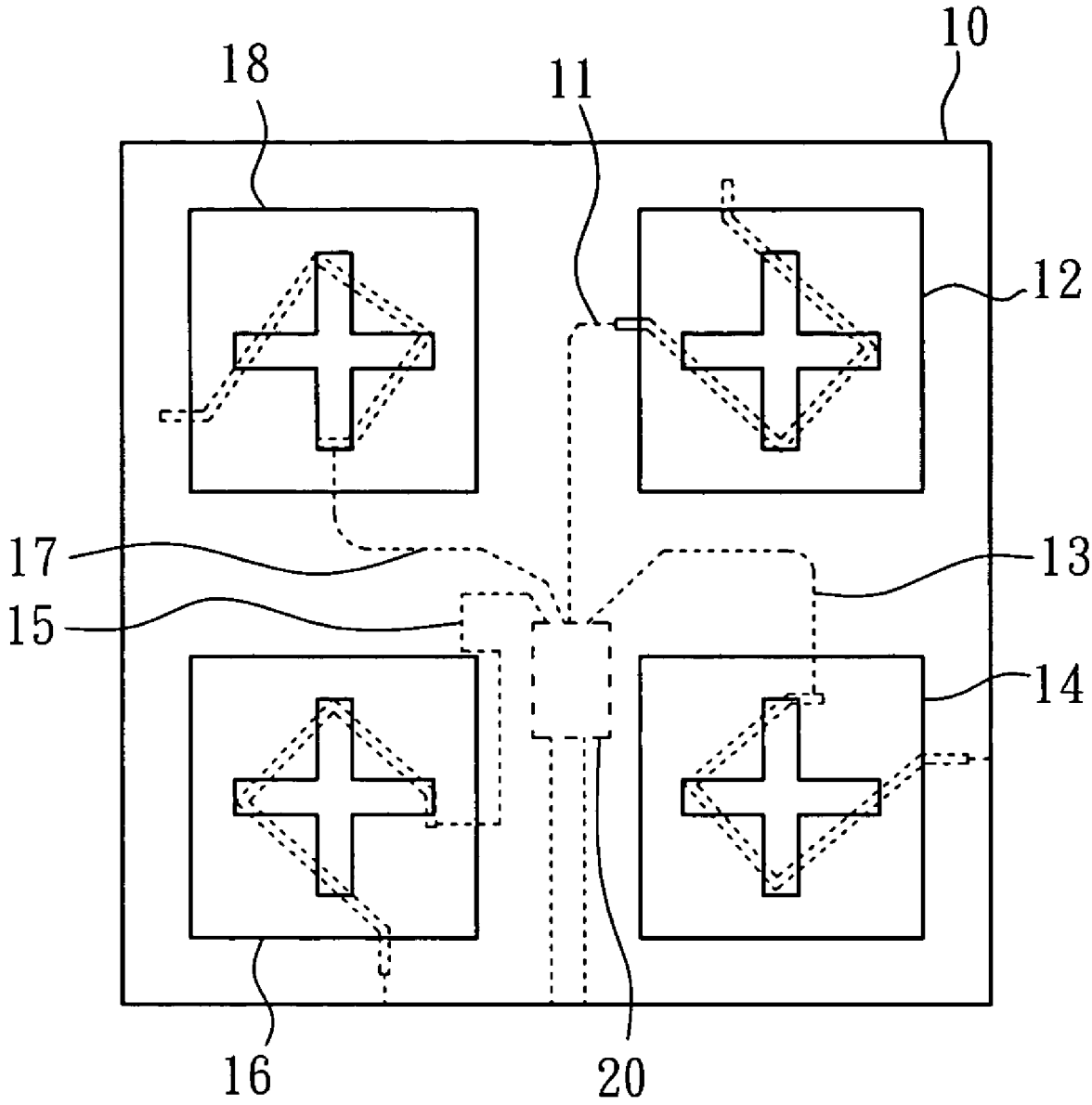
FIG. 2 is a diagram of circularly polarized antenna according to the invention.

As shown in FIG. 2, the circularly polarized antenna 10 according to the present invention comprises the following elements:

antenna elements 12, 14, 16, and 18, with the structure of every antenna element being identical; the antenna 12 is used for illustration, the scope of claims shall, however, not be restricted.

Figure 3:
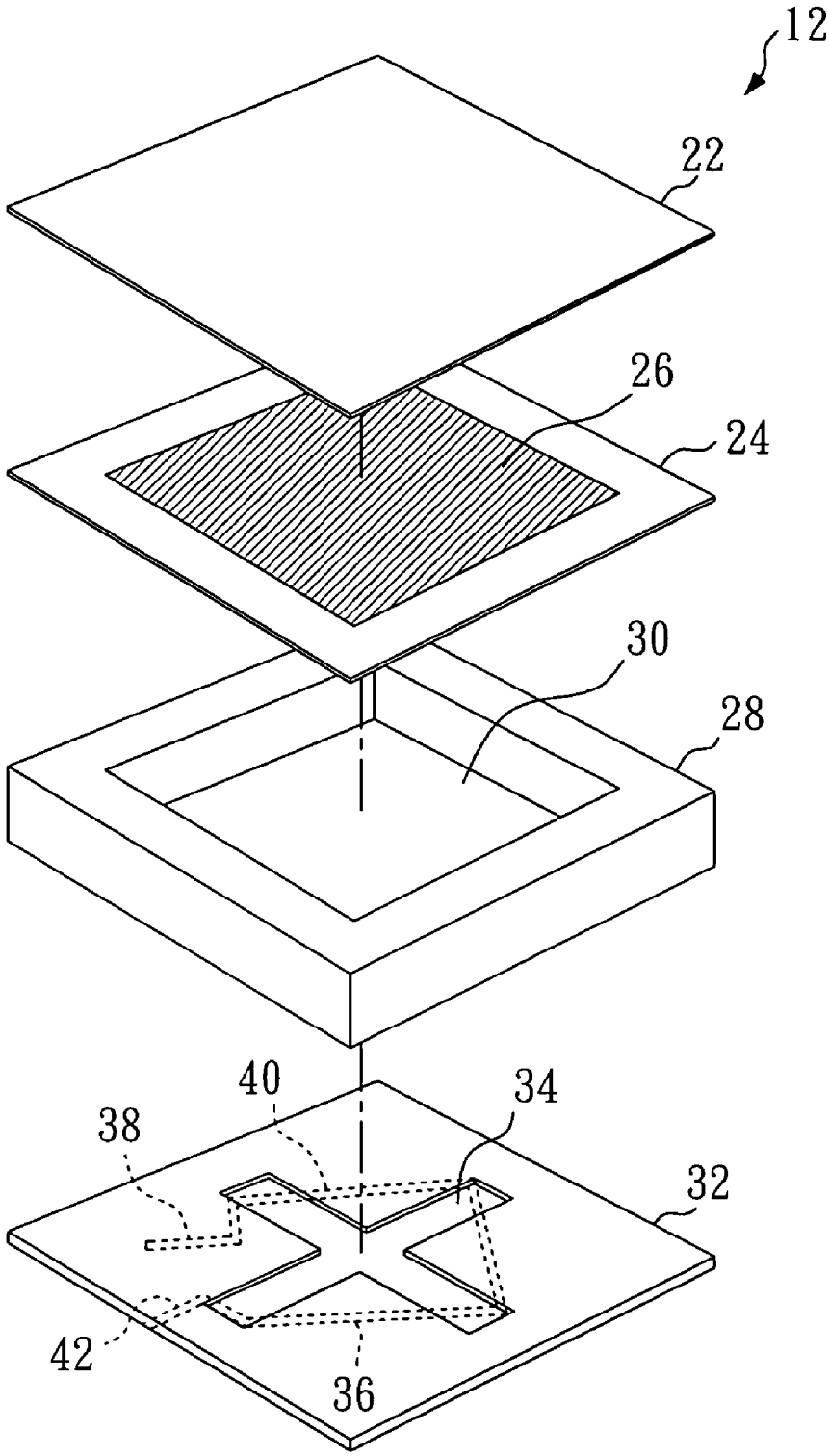
FIG. 3 is a diagram of the antenna element of the circularly polarized antenna according to the invention.

As shown in FIG. 3, the antenna element 12 further comprises: protection film 22, microstrip antenna (comprises supporting stratum 24 and patch 26 on the upper surface of the supporting stratum 24), substrate 28 with a cuboid-slot 30 in the center, and substrate 32 with cross-slot 34 on the upper surface and metal wire 36 on the lower surface. Substrate 32, with cross-slot 34 on the upper surface and metal wire 36 on the lower surface, can also serve as a slot antenna and combine with substrate 28 with the cuboid-slot 30 in the center to form the slot coupling apparatus.

Therefore, the above-mentioned elements are arranged from the top down as protection film 22, microstrip antenna, and slot coupling apparatus, and illustrated as the following:

Protection film 22 can provide the protection apparatus to prevent mist and dust from entering, and is better to be stuck on the upper surface of surface stratum 24. Moreover, protection film 22 is a selective element to be determined whether or not to be stuck on the upper surface of antenna element in accordance to the user's actual need.

Supporting stratum 24 can be paper, candypaper, dielectric membrane with material called prepreg, or other membrane or paper made from non-metal materials. The upper surface of supporting stratum 24 receives patch 26, which is preferably copper foil and preferably sticks to the upper surface of surface stratum 24 and has a size 10 mm*10 mm. The size of patch 26 can be determined according to the user's actual need and shall not be restricted. The supporting stratum 24 together with patch 26 serves the function of microstrip antenna.

Substrate 28 can be plastic board, but preferably is FR4 substrate. There is an opening 30 in the center of substrate 28 forming a cuboid-slot. The size of opening 30 is preferably the same as that of patch 26. Opening 30 provides room for placement so the user can allow it to fill with air preferably, or make it a vacuum, or place therein material with low dielectric constant to lower the dielectric loss produced by the coupling of figure polarization signals. Moreover, the material with low dielectric constant can provide the function of fine tuning the circularly polarized antenna 10 according to the invention.

Substrate 32 can be of a material called duroid 5870, 5880, or microwave substrate 6010 to provide better ability of transmitting and receiving the circularly polarized signals. The upper surface of substrate is covered by a layer of copper foil, and the center of the copper foil forms a cross figure 34. Thus, substrate 32 and cross figure 34 form the cross-slot. Then, the method of manufacturing a printed circuit is applied to form metal wire 36 on the lower surface of substrate 32. Therefore, substrate 32 with cross-slot and metal wire 36 can be viewed as a slot antenna and can receive and transmit the circularly polarized signal to power line 11. Metal wire 36 comprises: signal input line 38, curve line 40, and signal output line 42. The figure of curve line 40 is preferably inverse-U shape; the signal input line 38 and signal output line 42 cross with the cross figure via projection. Due to metal wire 36 respectively crossing with each of the four corners of the cross figure via projection, its physical mechanism are the 0, 90, 180, and 270 degrees phase formed by metal wire 36 at the four ends. The physical mechanism corresponds to four ends of the quadrants of 0, 90, 180, and 270 degrees in relative position to provide the physical mechanism of shifting phase. The physical mechanism will continuously apply in the dividing circuit of circularly polarized antenna 10 according to the invention. Signal input line 38 is used to receive the circularly polarized signals. When the users design the figure of metal wire 36, they may precede the design from the angle of transmitting antenna. That is, input line 38 will output the circularly polarization signals to curve line 40, and signal output line 42 will output the circularly polarized signals to power line 11.

An end of each of the power lines 11, 13, 15, and 17 respectively and electrically connects to signal output line 42 of antenna element 12, 14, 16, and 18, and the other end of all the power lines 11, 13, 15 and 17 electrically connect to a power divider 20. Moreover, assuming power line 15 has the shortest length, its length preferably equals to a quarter of the work frequency wavelength of the circularly polarized antenna 10 according to the invention. Power line 17 is preferably to be a quarter wavelength longer than that of power line 15. Power line 11 is preferably to be a quarter wavelength longer than that of power line 17. Power line 13 is preferably to be a quarter wavelength longer than that of power line 11. Also, 4-way power divider has the advantage of layout operation compared to 2-way power divider.

Power divider 20 is preferably a 4-way power divider with an end electrically connected to power lines 11, 13, 15, and 17 and the other end of the power divider electrically connects to a demodulator. The function of power divider 20 is to operate the division of power to make the power amplitude to be evenly divided to every power line and antenna element. Due to the manufacture of circularly polarized antenna 10 according to the invention being similar to the manufacture of the general printed circuit, the method is simple and the expense is low.

Therefore, the circularly polarized antenna 10 according to present invention can transmit and receive circularly polarized signals via the microstrip antenna, receive the said polarization signals via the slot coupling apparatus and couple it to the metal wire 36, and output the circularly polarized signals via the signal output line 42 of the metal wire 36. Thus, users only have to adjust the position of the antenna element and operate in cooperation with phase; thus, they can receive circularly polarized signals. For example, signal input line 38 of antenna elements 12, 14, 16 and 18 has relative position of 0, 90, 180, and 270 degrees. Operating in cooperation with the lengths of power lines 11, 13, 15, and 17, the phase differences in timing of antenna elements 12, 14, 16, and 18 are also circularly polarized signals with 0, 90, 180, and 270 degrees. The purpose for circularly polarized antenna 10 according to invention to receive circularly polarized signals is achieved. In addition, antenna elements 12, 14, 16, and 18 can be treated as improved version of traditional antenna elements. Applying the shifting mechanism generally only used in dividing circuit to antenna element 12, 14, 16, and 18 has the characteristic of higher bandwidth. Moreover, the users can attain the purpose for receiving right-hand or left-hand polarization signals via arranging the feeding order of metal wire 36.

Figure 4:
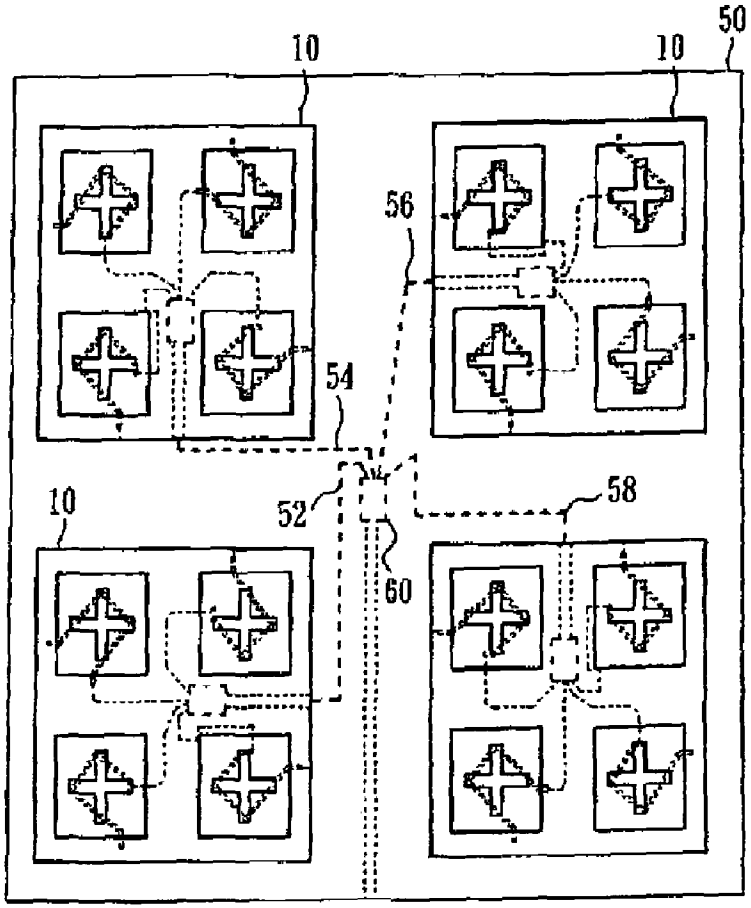
FIG. 4 is a diagram of the circularly polarized array antenna according to the invention.

As shown in FIG. 4, a circularly polarized array antenna 50 according to the invention is formed by plurality of circularly polarized antennas according to the invention, that can be in numbers of 4, 16, 64, etc, and respectively and electrically connect to power divider 60 via power lines 52, 54, 56 and 58. The quantity of circularly polarized antennas according to the invention is preferably 4, but shall not be restricted to this quantity. The operation principle of circularly polarized array antenna 50 according to the invention is identical to that of circularly polarized array antenna 10, thus, further description thereof is omitted. Obviously, the greater the quantity of circularly polarized antennas 10 the circularly polarized array antenna 50 comprises according to the invention, the better the transmitting/receiving ability of its circularly polarization signals.

Figure 5:
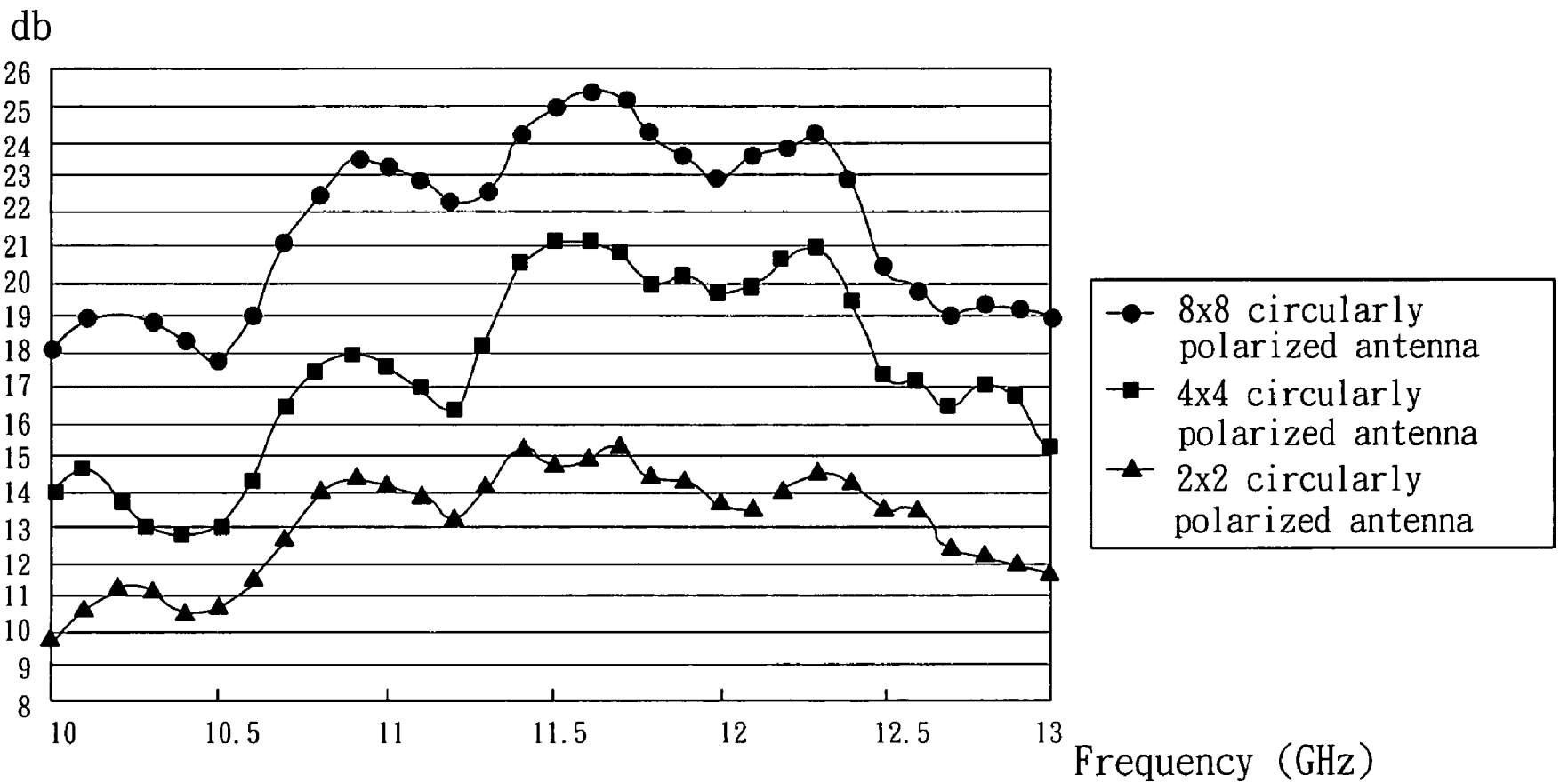
FIG. 5 is a diagram of performance of the gain of the circularly polarized array antenna according to the invention.
Figure 6:
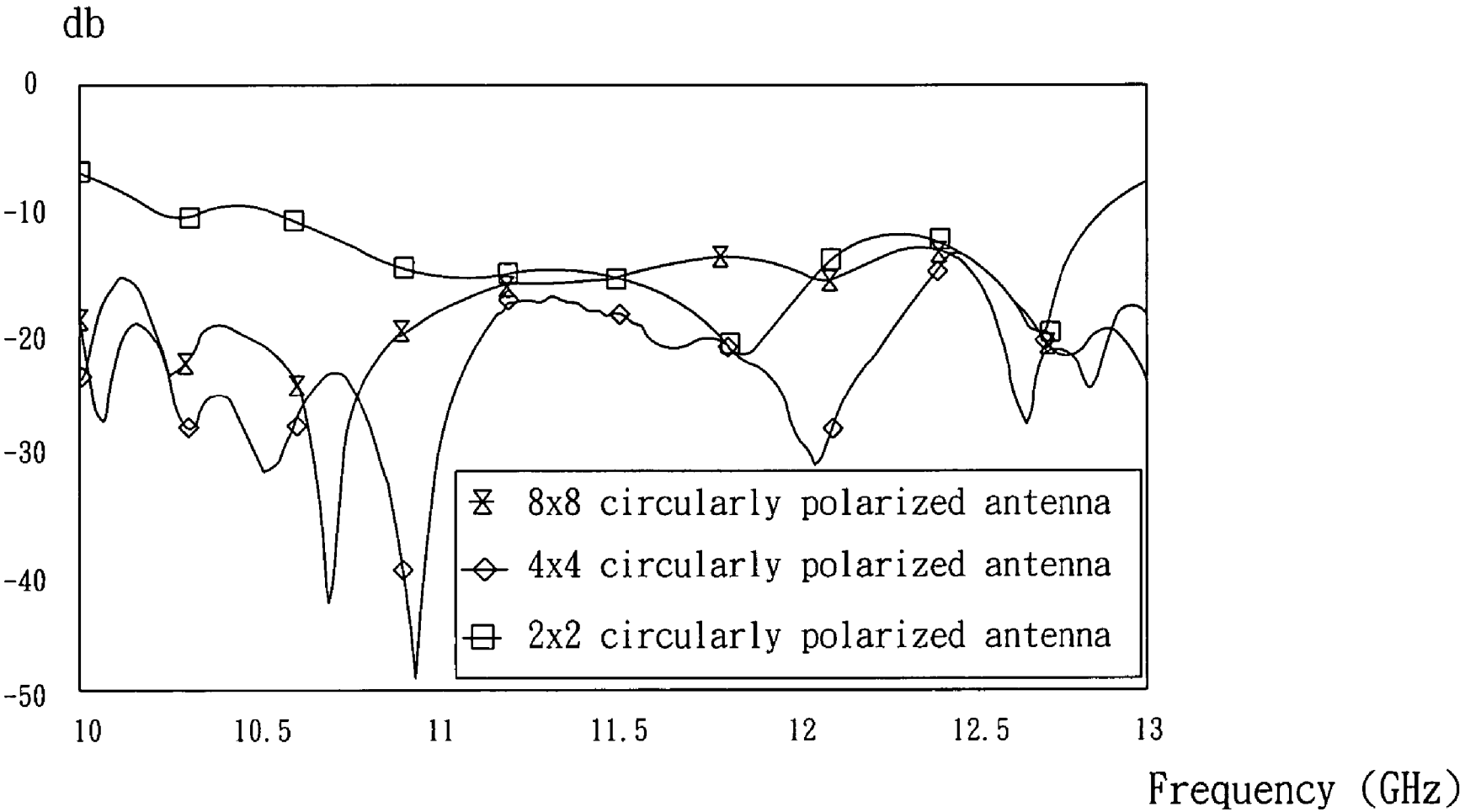
FIG. 6 is a diagram of performance of the return loss of the circularly polarized array antenna according to the invention.

As shown in FIG. 5, a circularly polarized array antenna 50 with 64 circularly polarized antennas 10 is better in transmitting/receiving circularly polarized signals than those with 16 and 4 circularly polarized antennas 10. Moreover, the greater the quantity of circularly polarized antennas 10 the circularly polarized array antenna 50 comprises according to the invention, the lower the gain value of the return loss; thus it is easier for the circularly polarized array antenna 50 according to the invention to recieve circularly polarized signals. As shown in FIG. 6, between the frequency band 11 GHz, the gain of return loss of circularly polarized array antenna 50 with 64 circularly polarized antenna 10 according to the invention can satisfy a user's need in gain value of return loss in this frequency band.

The circularly polrized antenna according to the present invention differs from the traditional circularly polarized antenna in the application of shifting mechanism generally used in the dividing circuit to operate in antenna elements 12, 14, 16, and 18. The shifting mechanism is formed by power lines via non-continuous points of every quarter wavelength (the four ends of the cross-slot). In the dividing circuit, a plurality of power lines and power divider form the circularly polarized array antenna 50. The arrangement of the cuboid slot further reduces the medium loss to make circularly polarized array antenna 50 according to the invention not only send/receive circularly polarized signals, and have good signal-transmitting/receiving ability, but also have the characteristics of low cost and ease of manufacture. Thus, the invention satisfies a user's need in transmitting/receiving circularly polarized signals.

Although the present invention has been explained in relation to its preferred embodiment, it is to be understood that many other possible modifications and variations can be made without departing from the spirit and scope of the invention as hereinafter claimed.

What is claimed is:

1. A circularly polarized array antenna for receiving and transmitting a circularly polarized signal, comprising:

a plurality of circularly polarized antennas with phase shift mechanism, for receiving the circularly polarized signal;

a plurality of power lines, each of the power lines differing from each other in length and coupled to the circularly polarized antennas respectively; and a power divider, coupled to the power lines for receiving the circularly polarized signal from the circularly polarized antennas and transmitting the circularly polarized signal, wherein each of the circularly polarized antennas comprises a plurality of antenna elements and each of the antenna elements comprises a microstrip antenna and a slot coupling apparatus, wherein the slot coupling apparatus comprises a substrate and a slot antenna;

an opening defined in the center of the substrate and forming a cuboid slot, a cross figure defined on an upper surface of the slot antenna, and a metal wire formed on a lower surface of the slot antenna.

2. The circularly polarized array antenna as claimed in claim 1, wherein the circularized antennas element respectively operates in cooperation with the power lines to provide the phase shift mechanism.

3. The circularly polarized array antenna as claimed in claim 1, wherein the circularly polarized array antenna is a right-hand or a left-hand polarized array antenna.

4. The circularly polarized array antenna as claimed in claim 1, wherein the metal wire crosses with the cross figure via projection.

5. The circularly polarized array antenna as claimed in claim 1, wherein the metal wire crosses with each of the four corners of the cross figure via projection.

6. The circularly polarized array antenna as claimed in claim 1, wherein the cuboid slot contains air.

7. The circularly polarized array antenna as claimed in claim 1, wherein the cuboid slot contains materials with dielectric coefficient to fine tune a work frequency of the antenna.

8. The circularly polarized array antenna as claimed in claim 1, wherein the substrate is a microwave substrate FR4.

9. The circularly polarized array antenna as claimed in claim 1, wherein a substrate of the slot-antenna is duroid 5870, 5800 or microwave substrate 6010.

10. The circularly polarized array antenna as claimed in claim 1, each of the antenna element further comprises a protection film coupled to an upper surface of the microstrip antenna.

11. The circularly polarized array antenna as claimed in claim 1, wherein the microstrip antenna comprises a medium membrane and a patch, wherein the patch is stuck on an upper surface of the medium membrane.

12. The circularly polarized array antenna as claimed in claim 11, wherein the medium membrane is prepreg membrane.

13. The circularly polarized array antenna as claimed in claim 11, wherein the patch is a rectangular copper foil.

* * * * *